US011992064B2

(12) United States Patent
Lee

(10) Patent No.: US 11,992,064 B2
(45) Date of Patent: May 28, 2024

(54) METHOD FOR CONTROLLING POWER OF HEATER OF AEROSOL GENERATING APPARATUS WHICH CAN BE CONTINUOUSLY USED AND AEROSOL GENERATING APPARATUS THEREOF

(71) Applicant: KT&G CORPORATION, Daejeon (KR)

(72) Inventor: Jae Min Lee, Siheung-si (KR)

(73) Assignee: KT&G CORPORATION, Daejeon (KR)

( * ) Notice: Subject to any disclaimer, the term of this patent is extended or adjusted under 35 U.S.C. 154(b) by 786 days.

(21) Appl. No.: 17/057,777

(22) PCT Filed: Oct. 23, 2019

(86) PCT No.: PCT/KR2019/014002
§ 371 (c)(1),
(2) Date: Nov. 23, 2020

(87) PCT Pub. No.: WO2020/101205
PCT Pub. Date: May 22, 2020

(65) Prior Publication Data

US 2021/0204611 A1 Jul. 8, 2021

(30) Foreign Application Priority Data

Nov. 16, 2018 (KR) ..... 10-2018-0141973

(51) Int. Cl.
*A24F 40/57* (2020.01)
*A24F 40/10* (2020.01)

(52) U.S. Cl.
CPC ..... *A24F 40/57* (2020.01); *A24F 40/10* (2020.01)

(58) Field of Classification Search
CPC ..... A24F 40/57; A24F 40/10; A24F 40/20; A24F 40/50; A24F 40/46; A24F 40/51;
(Continued)

(56) References Cited

U.S. PATENT DOCUMENTS 4,947,874 A 8/1990 Brooks et al.
9,423,152 B2 8/2016 Ampolini et al.
(Continued)

FOREIGN PATENT DOCUMENTS

CN 1045691 A 10/1990
CN 103404969 A 11/2013
(Continued)

OTHER PUBLICATIONS

Extended European Search Report dated Oct. 15, 2021, issued by the European Patent Office in application No. 19885843.3.
(Continued)

*Primary Examiner* — Jean F Duverne
(74) *Attorney, Agent, or Firm* — Sughrue Mion, PLLC

(57) ABSTRACT

Provided is an aerosol generating apparatus including: a heater generating an aerosol by heating an aerosol generating substrate; and a controller monitoring and controlling power supplied to the heater, wherein, upon receiving an input of reheating the heater within a preset time, after the heater reaches the first target temperature and generates an aerosol, the controller controls the heater to generate an aerosol according to a second target temperature lower than the first target temperature.

9 Claims, 7 Drawing Sheets

(58) Field of Classification Search
CPC ..... H05B 6/06; H05B 1/0244; H05B 1/02; G05B 11/28; H02J 7/007192
See application file for complete search history.

(56) References Cited

U.S. PATENT DOCUMENTS

| | | | |
|---|---|---|---|
| 9,713,345 | B2 | 7/2017 | Farine et al. |
| 10,624,393 | B2 | 4/2020 | Kuczaj |
| 10,674,770 | B2 | 6/2020 | Talon |
| 2014/0299141 | A1 | 10/2014 | Flick |
| 2014/0366894 | A1 | 12/2014 | Liu |
| 2016/0374397 | A1 | 12/2016 | Jordan et al. |
| 2018/0020735 | A1 | 1/2018 | Bilat et al. |
| 2019/0059448 | A1 | 2/2019 | Talon |
| 2019/0166914 | A1 | 6/2019 | Qiu |
| 2019/0216137 | A1 | 7/2019 | Liu |
| 2019/0387792 | A1 | 12/2019 | Qiu |

FOREIGN PATENT DOCUMENTS

| | | | | |
|---|---|---|---|---|
| CN | 103889258 | A | 6/2014 | |
| CN | 103974638 | A | 8/2014 | |
| CN | 105208884 | A | 12/2015 | |
| CN | 106820266 | A | 6/2017 | |
| EP | 2 471 392 | B1 | 7/2012 | |
| EP | 2609820 | A1 * | 7/2013 | ..... A24B 15/167 |
| EP | 3 042 576 | A1 | 7/2016 | |
| KR | 10-2015-0084779 | A | 7/2015 | |
| KR | 10-2015-0102924 | A | 9/2015 | |
| KR | 10-1614171 | B1 | 4/2016 | |
| KR | 10-1792905 | B1 | 11/2017 | |
| WO | 2014/054035 | A1 | 4/2014 | |
| WO | 2018/014817 | A1 | 1/2018 | |
| WO | 2018-019786 | A1 | 2/2018 | |
| WO | WO-2018091627 | A1 * | 5/2018 | ..... A24F 40/46 |

OTHER PUBLICATIONS

International search report for PCT/KR2019/014002 dated Jan. 29, 2020.

Korean office action for Koran application No. 110-2018-0141973 dated Jun. 10, 2020.

Office Action dated Mar. 22, 2023 in Chinese Application No. 201980034759.2.

* cited by examiner

METHOD FOR CONTROLLING POWER OF HEATER OF AEROSOL GENERATING APPARATUS WHICH CAN BE CONTINUOUSLY USED AND AEROSOL GENERATING APPARATUS THEREOF

CROSS-REFERENCE TO RELATED APPLICATIONS

This application is a National Stage of National Stage of PCT/KR2019/014002 filed Oct. 23, 2019, which claims priority under U.S.C. § 119(a) to Korea Patent Application No. 10-2018-0141973 filed on Nov. 16, 2018.

TECHNICAL FIELD

The present disclosure relates to a method of controlling power of a heater of an aerosol generating apparatus capable of being used continuously and an aerosol generating apparatus thereof, wherein by appropriately controlling the power of the heater of the aerosol generating apparatus, a user may be provided with a consistent feeling of smoking even when the user reuses the aerosol generating apparatus shortly after previous use.

BACKGROUND ART

Recently, the demand for alternative ways of overcoming the disadvantages of traditional cigarettes has increased. For example, there is growing demand for a method of generating aerosol by heating an aerosol generating material in cigarettes, rather than by combusting cigarettes. Accordingly, research into a heating-type cigarette and a heating-type aerosol generator has been actively conducted.

When an aerosol generating apparatus is continuously used, a temperature of the periphery of a heater that generates an aerosol rises to a significant level. As a result, a temperature of an aerosol that is affected by the temperature of the periphery may rapidly rise, and thus, a user may inhale a hot aerosol. Also, when the user resumes smoking shortly after previous smoking involving at least one puff, the heater may be heated to a preheating target temperature before a temperature of the heater sufficiently falls. In this case, an aerosol generating substrate may not be supplied with the sufficient amount of heat energy from the heater, and thus, the atomization amount may be reduced in an initial puff.

DESCRIPTION OF EMBODIMENTS

Technical Problem

Provided are a method of controlling power of a heater of an aerosol generating apparatus which may be continuously used and an aerosol generating apparatus thereof, wherein a hot aerosol may not be generated even when the aerosol generating apparatus is continuously used.

Solution to Problem

According to an aspect of the present disclosure, an aerosol generating apparatus may include: a heater generating an aerosol by heating an aerosol generating substrate; and a controller monitoring and controlling power supplied to the heater, wherein the controller controls the heater to generate an aerosol according to a second target temperature lower than the first target temperature upon receiving an input of reheating the heater within a preset time, after the heater reaches the first target temperature and generates an aerosol.

According to another aspect of the present disclosure, a method of controlling power supplied to a heater of an aerosol generating apparatus, may include: a heater heating operation of heating the heater to a first target temperature; an input detection operation of detecting whether or not an input of reheating the heater within a preset time is received when an aerosol is generated in the heater which has reached the first target temperature; and a heater reheating operation of heating the heater to a second target temperature when the input is received within the time, wherein the second target temperature is lower than the first target temperature.

According to another aspect of the present disclosure, a computer-readable recording medium may store a program for embodying the method.

ADVANTAGEOUS EFFECTS OF DISCLOSURE

According to the present disclosure, even if a user continuously uses an aerosol generating apparatus, the user may not be scalded by a hot aerosol or may not feel uncomfortable.

Also, although the user continuously uses the aerosol generating apparatus, the user may inhale the consistent atomization amount of aerosol.

BEST MODE

Figure 1:
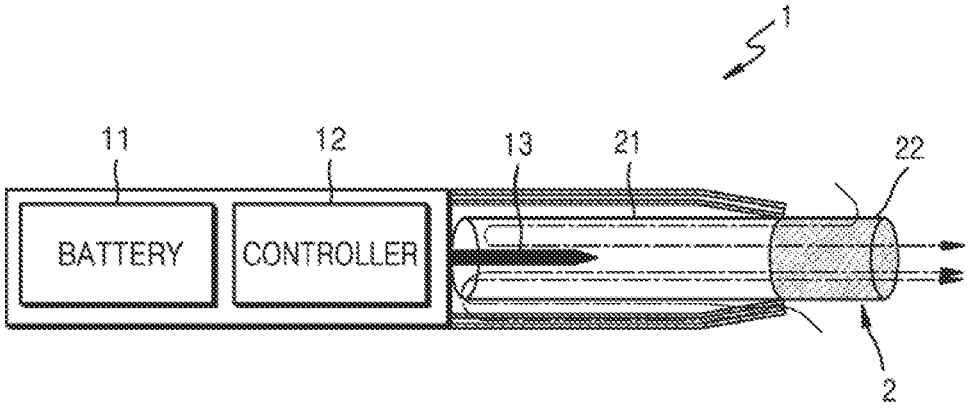
FIGS. 1 through 3 are diagrams illustrating examples in which a cigarette is inserted into an aerosol generating apparatus.

According to an aspect of the present disclosure, an aerosol generating apparatus may include: a heater configured to generate an aerosol by heating an aerosol generating substrate; and a controller configured to monitor and control power supplied to the heater such that the heater generates the aerosol at a second target temperature lower than a first target temperature upon receiving an input of reheating the heater within a preset time after generating the aerosol with the first target temperature.

The controller may calculate the second target temperature on the basis of the first target temperature.

The controller may calculate the second target temperature on the basis of a temperature of the heater at a time point when receiving the input.

The controller may calculate the second target temperature according to a linear equation involving the temperature of the heater at the time point when the input is received.

The controller may acquire the second target temperature with reference to a table where the second target temperature is associated with a temperature range to which a temperature of the heater belongs at a time point when receiving the input.

The controller may determine that preheating of the heater is completed when a maintenance time period during which the first target temperature is maintained or a maintenance time period during which the second target temperature is maintained expires, and control the power such that the maintenance time period during which the second target temperature is longer than the maintenance time period during which the first target temperature is maintained.

The maintenance time period corresponding to the second target temperature may be calculated on the basis of a temperature of the heater at a time point when the input is received.

The controller may control the power such that a second arrival time period during which the heater is heated and reaches the second target temperature is longer than a first arrival time period during which the heater is heated and reaches the first target temperature.

The controller may acquire the second target temperature with reference to a table in which the second target temperature is associated with a temperature range to which a temperature of the heater belongs at a time point when the input is received.

According to another aspect of the present disclosure, a method of controlling power supplied to a heater of an aerosol generating apparatus, may include: a heater heating operation of heating the heater to a first target temperature; an input detection operation of detecting whether or not an input of reheating the heater within a preset time is received when an aerosol is generated in the heater which reaches the first target temperature; and a heater reheating operation of heating the heater to a second target temperature when the input is received within the time, wherein the second target temperature is lower than the first target temperature.

The heater reheating operation may include calculating the second target temperature on the basis of the first target temperature.

The heater reheating operation may include calculating the second target temperature on the basis of a temperature of the heater at a time point when the input is received.

The heater reheating operation may include calculating the second target temperature according to a linear equation involving a temperature of the heater at the time point when the input is received.

The heater reheating operation may include acquiring the second target temperature with reference to a table where the second target temperature is associated with a temperature range to which a temperature of the heater belongs at a time point when the input is received.

The heater reheating operation may include determining that preheating of the heater is completed when a preset maintenance time period during which the first target temperature is maintained or a time period during which the second target temperature is maintained expires, and controlling a maintenance time period during which the second target temperature is maintained to be longer than a maintenance time period during which the first target temperature is maintained.

The maintenance time period during which the second target temperature is maintained may be calculated on the basis of a temperature of the heater at a time point when the input is received.

The heater reheating operation may include controlling a second arrival time period during which the heater is heated and reaches the second target temperature to be longer than a first arrival time period during which the heater is heated and reaches the first target temperature.

The heater reheating operation may include acquiring the second arrival time period with reference to a table where the second arrival time period is associated with a temperature range to which a temperature of the heater belongs at a time point when the input is received.

According to another aspect of the present disclosure, a computer-readable recording medium may store a program for executing the method.

MODE OF DISCLOSURE

As the present disclosure allows for various changes and numerous embodiments, particular embodiments will be illustrated in the drawings and described in detail in the written description. The attached drawings for illustrating the present disclosure are referred to in order to gain a sufficient understanding, the merits thereof, and the objectives accomplished by the implementation. However, the present disclosure may have different forms and should not be construed as being limited to the descriptions set forth herein.

The embodiments of the present disclosure will be described below in more detail with reference to the accompanying drawings. Those elements that are the same or are in correspondence are rendered the same reference numeral regardless of the figure number, and redundant explanations are omitted.

While such terms as "first," "second," etc., may be used to describe various elements, such elements must not be limited to the above terms. The above terms are used only to distinguish one element from another.

An expression used in the singular encompasses the expression of the plural, unless it has a clearly different meaning in the context.

In the present specification, it is to be understood that the terms such as "including," "having," and "comprising" are intended to indicate the existence of the features or elements disclosed in the specification, and are not intended to preclude the possibility that one or more other features or elements may exist or may be added.

When a certain embodiment may be implemented differently, a specific process order may be performed differently from the described order. For example, two consecutively described processes may be performed substantially at the same time or performed in an order opposite to the described order.

Hereinafter, embodiments of the present disclosure will be described in detail with reference to the drawings.

Figure 2:
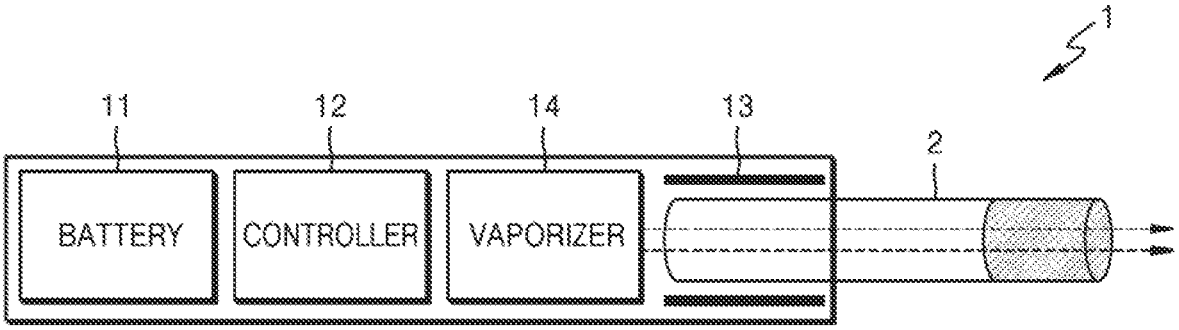
Figure 3:
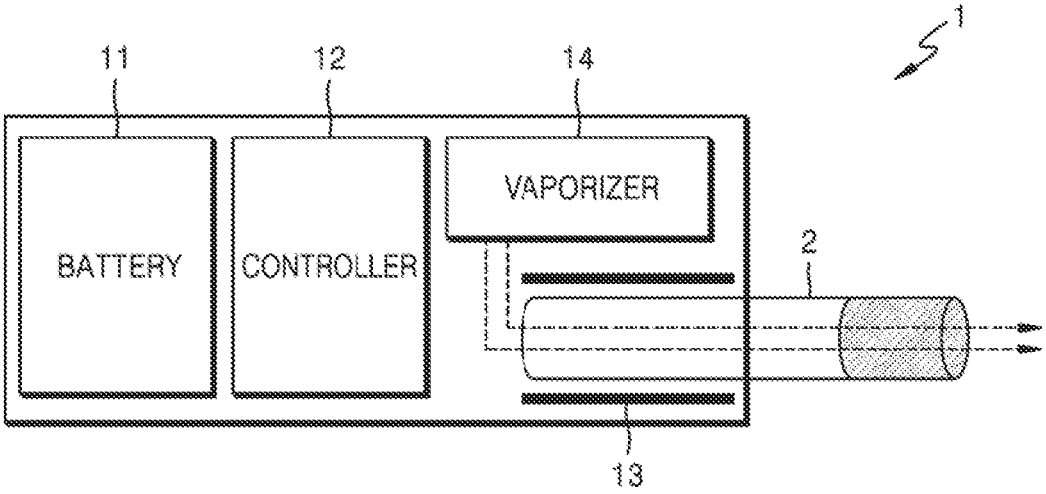

FIGS. 1 through 3 are diagrams showing examples in which a cigarette is inserted into an aerosol generating apparatus.

Referring to FIG. 1, an aerosol generator 1 includes a battery 11, a controller 12, and a heater 13. Referring to FIG. 2 and FIG. 3, the aerosol generator 1 further includes a vaporizer 14. Also, a cigarette 2 may be inserted into an inner space of the aerosol generator 1.

The elements related to the embodiment are illustrated in the aerosol generator 1 of FIGS. 1 to 3. Therefore, one of ordinary skill in the art would appreciate that other universal elements than the elements shown in FIGS. 1 to 3 may be further included in the aerosol generator 1.

Also, FIGS. 2 and 3 show that the aerosol generator 1 includes the heater 13, but if necessary, the heater 13 may be omitted.

In FIG. 1, the battery 11, the controller 12, and the heater 13 are arranged in a row. Also, FIG. 2 shows that the battery 11, the controller 12, the vaporizer 14, and the heater 13 are arranged in a row. Also, FIG. 3 shows that the vaporizer 14 and the heater 13 are arranged in parallel with each other. However, an internal structure of the aerosol generator 1 is not limited to the examples shown in FIGS. 1 to 3. That is, according to a design of the aerosol generator 1, arrangement of the battery 11, the controller 12, the heater 13, and the vaporizer 14 may be changed.

When the cigarette 2 is inserted into the aerosol generator 1, the aerosol generator 1 operates the heater 13 and/or the vaporizer 14 to generate aerosol from the cigarette 2 and/or the vaporizer 14. The aerosol generated by the heater 13 and/or the vaporizer 14 may be transferred to a user via the cigarette 2.

If necessary, even when the cigarette 2 is not inserted in the aerosol generator 1, the aerosol generator 1 may heat the heater 13.

The battery 11 supplies the electric power used to operate the aerosol generator 1. For example, the battery 11 may supply power for heating the heater 13 or the vaporizer 14 and supply power for operating the controller 12. In addition, the battery 11 may supply power for operating a display, a sensor, a motor, and the like installed in the aerosol generator 1.

The controller 12 controls the overall operation of the aerosol generator 1. In detail, the controller 12 may control operations of other elements included in the aerosol generator 1, as well as the battery 11, the heater 13, and the vaporizer 14. Also, the controller 12 may check the status of each component in the aerosol generator 1 to determine whether the aerosol generator 1 is in an operable state.

The controller 12 includes at least one processor. A processor can be implemented as an array of a plurality of logic gates or can be implemented as a combination of a general-purpose microprocessor and a memory in which a program executable in the microprocessor is stored. It will be understood by one of ordinary skill in the art that the present disclosure may be implemented in other forms of hardware.

The heater 13 may be heated by the electric power supplied from the battery 11. For example, when the cigarette is inserted in the aerosol generator 1, the heater 13 may be located outside the cigarette. Therefore, the heated heater 13 may raise the temperature of an aerosol generating material in the cigarette.

The heater 13 may be an electro-resistive heater. For example, the heater 13 includes an electrically conductive track, and the heater 13 may be heated as a current flows through the electrically conductive track. However, the heater 13 is not limited to the above example, and any type of heater may be used provided that the heater is heated to a desired temperature. Here, the desired temperature may be set in advance on the aerosol generator 1, or may be set by a user.

In addition, in another example, the heater 13 may include an induction heating type heater. In detail, the heater 13 may include an electrically conductive coil for heating the cigarette in an induction heating method, and the cigarette may include a susceptor that may be heated by the induction heating type heater.

For example, the heater 13 may include a tubular type heating element, a plate type heating element, a needle type heating element, or a rod type heating element, and may heat the inside or outside of the cigarette 2 according to the shape of the heating element.

Also, there may be a plurality of heaters 13 in the aerosol generator 1. Here, the plurality of heaters 13 may be arranged to be inserted into the cigarette 2 or on the outside of the cigarette 2. Also, some of the plurality of heaters 13 may be arranged to be inserted into the cigarette 2 and the other may be arranged on the outside of the cigarette 2. In addition, the shape of the heater 13 is not limited to the example shown in FIGS. 1 to 3, but may be manufactured in various shapes.

The vaporizer 14 may generate aerosol by heating a liquid composition and the generated aerosol may be delivered to the user after passing through the cigarette 2. In other words, the aerosol generated by the vaporizer 14 may move along an air flow passage of the aerosol generator 1, and the air flow passage may be configured for the aerosol generated by the vaporizer 14 to be delivered to the user through the cigarette.

For example, the vaporizer 14 may include a liquid storage unit, a liquid delivering unit, and a heating element, but is not limited thereto. For example, the liquid storage unit, the liquid delivering unit, and the heating element may be included in the aerosol generator 1 as independent modules.

The liquid storage may store a liquid composition. For example, the liquid composition may be a liquid including a tobacco containing material including a volatile tobacco flavor component, or a liquid including a non-tobacco material. The liquid storage unit may be detachable from the vaporizer 14 or may be integrally manufactured with the vaporizer 14.

For example, the liquid composition may include water, solvents, ethanol, plant extracts, flavorings, flavoring agents, or vitamin mixtures. The flavoring may include, but is not limited to, menthol, peppermint, spearmint oil, various fruit flavoring ingredients, etc. The flavoring agent may include components that may provide the user with various flavors or tastes. Vitamin mixtures may be a mixture of at least one of vitamin A, vitamin B, vitamin C, and vitamin E, but are not limited thereto. Also, the liquid composition may include an aerosol former such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivering unit. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but is not limited thereto.

In addition, the aerosol generator 1 may further include universal elements, in addition to the battery 11, the controller 12, the heater 13, and the vaporizer 14. For example, the aerosol generator 1 may include a display capable of outputting visual information and/or a motor for outputting tactile information. In addition, the aerosol generator 1 may include at least one sensor (a puff sensor, a temperature sensor, a cigarette insertion sensor, etc.) Also, the aerosol generator 1 may be manufactured to have a structure, in which external air may be introduced or internal air may be discharged even in a state where the cigarette 2 is inserted.

Although not shown in FIGS. 1 to 3, the aerosol generator 1 may configure a system with an additional cradle. For example, the cradle may be used to charge the battery 11 of the aerosol generator 1. Alternatively, the heater 13 may be heated in a state in which the cradle and the aerosol generator 1 are coupled to each other.

The cigarette 2 may be similar to a traditional combustive cigarette. For example, the cigarette 2 may include a first portion containing an aerosol generating material and a second portion including a filter and the like. The second portion of the cigarette 2 may also include the aerosol generating material. For example, an aerosol generating material made in the form of granules or capsules may be inserted into the second portion.

The entire first portion may be inserted into the aerosol generator 1 and the second portion may be exposed to the outside. Alternatively, only a portion of the first portion may be inserted into the aerosol generator 1 or the entire first portion and a portion of the second portion may be inserted into the aerosol generator 1. The user may puff aerosol while holding the second portion by the mouth of the user. At this time, the aerosol is generated by as the outside air passes through the first portion, and the generated aerosol passes through the second portion and is delivered to a user's mouth.

For example, the outside air may be introduced through at least one air passage formed in the aerosol generator 1. For example, the opening and closing of the air passage formed in the aerosol generator 1 and/or the size of the air passage may be adjusted by a user. Accordingly, the amount and quality of the aerosol may be adjusted by the user. In another example, the outside air may be introduced into the cigarette 2 through at least one hole formed in a surface of the cigarette 2.

Hereinafter, an example of the cigarette 2 will be described with reference to FIGS. 4 and 5.

Figure 4:
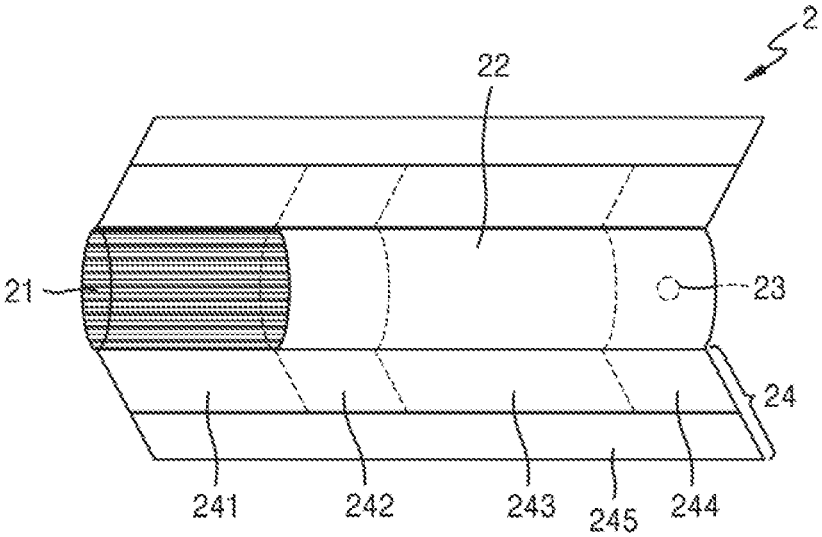
FIGS. 4 and 5 are views illustrating examples of a cigarette.
Figure 5:
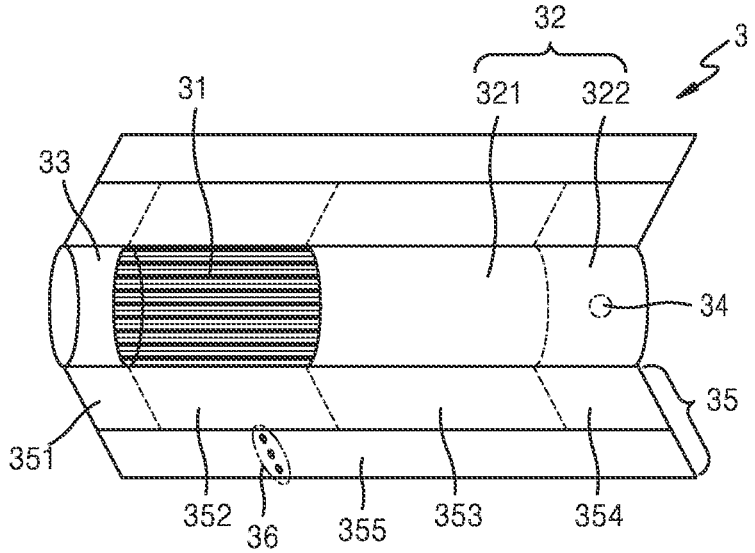

FIGS. 4 and 5 illustrate an example of a cigarette.

Referring to FIG. 4, the cigarette 2 includes a tobacco rod 21 and a filter rod 22. The first portion described above with reference to FIGS. 1 to 3 include the tobacco rod 21 and the second portion includes the filter rod 22.

In FIG. 4, the filter rod 22 is shown as a single segment, but is not limited thereto. In other words, the filter rod 22 may include a plurality of segments. For example, the filter rod 22 may include a first segment for cooling down the aerosol and a second segment for filtering a predetermined component included in the aerosol. Also, if necessary, the filter rod 22 may further include at least one segment performing another function.

The cigarette 2 may be packaged by at least one wrapper 24. The wrapper 24 may include at least one hole through which the outside air is introduced or inside air is discharged. For example, the cigarette 2 may be packaged by one wrapper 24. In another example, the cigarette 2 may be packaged by two or more wrappers 24. For example, the tobacco rod 21 may be packaged by a first wrapper 241, and the filter rod 22 may be packaged by wrappers 242 to 244. And the entire cigarette 2 may be packaged by another wrapper 245. When the filter rod 22 includes a plurality of segments, each segment may be packaged by separate wrappers 242, 243, and 244.

The tobacco rod 21 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. In addition, the tobacco rod 21 may include other additive materials like a flavoring agent, a wetting agent, and/or an organic acid. Also, a flavoring liquid such as menthol, humectant, etc. may be added to the tobacco rod 21 by being sprayed to the tobacco rod 21.

The tobacco rod 21 may be manufactured variously. For example, the tobacco rod 21 may be fabricated as a sheet or a strand. Also, the tobacco rod 21 may be fabricated by tobacco leaves that are obtained by fine-cutting a tobacco sheet. Also, the tobacco rod 21 may be surrounded by a heat conducting material. For example, the heat-conducting material may be, but is not limited to, a metal foil such as aluminum foil. For example, the heat conducting material surrounding the tobacco rod 21 may improve a thermal conductivity applied to the tobacco rod by evenly dispersing the heat transferred to the tobacco rod 21, and thereby improving tobacco taste. Also, the heat conducting material surrounding the tobacco rod 21 may function as a susceptor that is heated by an inducting heating type heater. Although not shown in the drawings, the tobacco rod 21 may further include a susceptor, in addition to the heat conducting material surrounding the outside thereof.

The filter rod 22 may be a cellulose acetate filter. In addition, the filter rod 22 is not limited to a particular shape. For example, the filter rod 22 may be a cylinder type rod or a tube type rod including a cavity therein. Also, the filter rod 22 may be a recess type rod. When the filter rod 22 includes a plurality of segments, at least one of the plurality of segments may have a different shape from the others.

Also, the filter rod 22 may include at least one capsule 23. Here, the capsule 23 may generate flavor or may generate aerosol. For example, the capsule 23 may have a structure, in which a liquid containing a flavoring material is wrapped with a film. The capsule 23 may have a circular or cylindrical shape, but is not limited thereto.

When the filter rod 22 includes a segment for cooling down the aerosol, the cooling segment may include a polymer material or a biodegradable polymer material. The front-end plug 33 may be located on a side of the tobacco rod 31 facing the filter rod 32. The front-end plug 33 may prevent the tobacco rod 31 from escaping to the outside and may prevent a liquefied aerosol from flowing from the tobacco rod 31 into an aerosol generating device (1 of FIGS. 1 to 3) during smoking.

The filter rod 32 may include a first segment 321 and a second segment 322. Here, the first segment 321 may correspond to the first segment of the filter rod 22 of FIG. 4, and the second segment 322 may correspond to the third segment of the filter rod 22 of FIG. 4.

The diameter and the total length of the cigarette 3 may correspond to the diameter and the total length of the cigarette 2 of FIG. 4. For example, the length of the front end plug 33 is about 7 mm, the length of the cigarette rod 31 is about 15 mm, the length of the first segment 321 is about 12 mm, and the length of the second segment 322 is about 14 mm. However, it is not limited thereto.

The cigarette 3 may be wrapped by at least one wrapper 35. At least one hole through which outside air flows in or inside gas flows out may be formed in the wrapper 35. For example, the front-end plug 33 may be wrapped by a first wrapper 241 351, the tobacco rod 31 may be wrapped by a second wrapper 352, the first segment 321 may be wrapped by by a third wrapper 353, and the second segment 322 may be wrapped by a fourth wrapper 354. Also, the entire cigarette 3 may be re-wrapped by a fifth wrapper 355.

Also, at least one perforation 36 may be formed in the fifth wrapper 355. For example, the perforation 36 may be formed in a region surrounding the tobacco rod 31, but is not limited thereto. The perforation 36 may serve to transfer heat generated by the heater 13 shown in FIGS. 2 and 3 into the tobacco rod 31.

Also, the second segment 322 may include at least one capsule 34. Here, the capsule 34 may serve to generate a flavor or serve to generate an aerosol. For example, the capsule 34 may have a structure in which a liquid containing perfume is wrapped in a film. The capsule 34 may have a spherical or cylindrical shape, but is not limited thereto.

Figure 6:
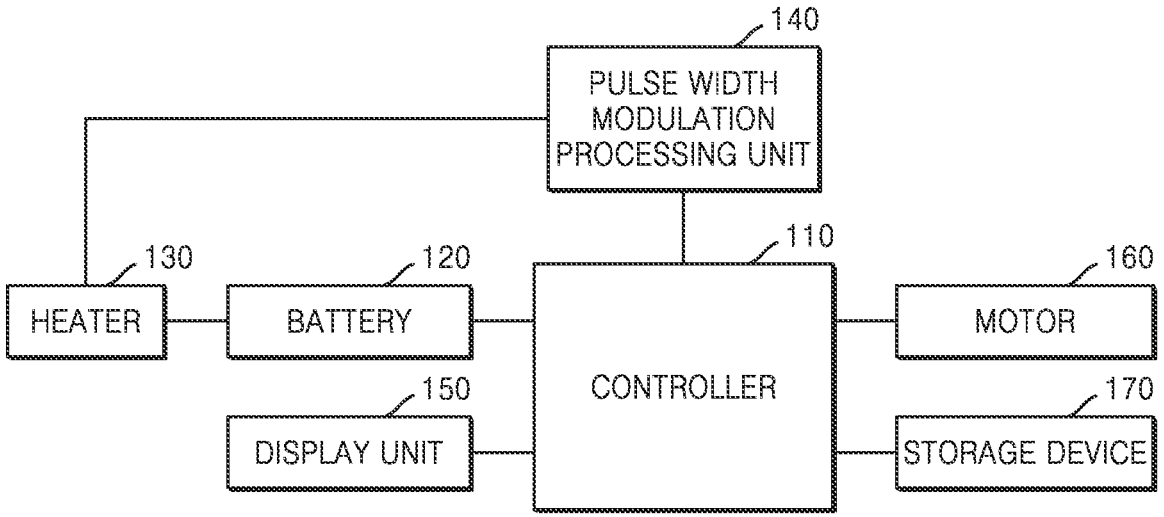
FIG. 6 is a block diagram of an example of an aerosol generating apparatus according to the present disclosure.

FIG. 6 is a block diagram of an example of an aerosol generating apparatus according to the present disclosure.

Referring to FIG. 6, an aerosol generating apparatus according to the present disclosure may include a controller 110, a battery 120, a heater 13, a pulse width modulation processing unit 140, a display unit 150, a motor 160, and a storage device 170. Hereinafter, the controller 110, the battery 120, the heater 130, and the vaporizer of FIG. 6 are the same components as the controller 12, the battery 11, the heater 130, and the vaporizer 14 described with reference to FIGS. 2 and 3.

The controller 110 controls overall operations of the battery 120, the heater 130, the pulse width modulation processing unit 140, the display unit 150, the motor 160, and the storage device 170 included in the aerosol generating apparatus. Although not illustrated in FIG. 6, according to one or more embodiments, the controller 110 may further include an input receiver (not shown) for receiving a button input or a touch input of a user and a communicator (not shown) capable of performing communication with an external communication device such as a user terminal. Although not illustrated in FIG. 6, the controller 110 may further include a module for performing a proportional integral differential (PID) control with respect to the heater 130.

The battery 120 may supply power to the heater 130, and the amount of power supplied to the heater 130 may be controlled by the controller 110.

The heater 130 generates heat by a resistance thereof when a current is applied thereto. Also, when an aerosol generating substrate contacts (is coupled to) the heated heater 130, an aerosol may be generated.

Through a method of transmitting a pulse width modulation (PWM) signal to the heater 130, the pulse width modulation processing unit 140 may allow the controller 110 to control power supplied to the heater 130. According to one or more embodiments, the pulse width modulation processing unit 140 may be included in the controller 110.

The display unit 150 may visually output various types of alarm messages generated in the aerosol generating apparatus such that a user using the aerosol generating apparatus identifies the alarm messages. The user may identify a low battery message, an overheating warning message of a heater, or the like output on the display unit 150 and take appropriate action before an operation of the aerosol generating apparatus stops or the aerosol generating apparatus is broken.

The motor 160 may be driven by the controller 110 to enable the user to recognize, through a tactile sensation, that the aerosol generating apparatus is ready to be used.

The storage device 170 stores various types of information which enables the controller 110 to appropriately control power supplied to the heater 130 to thereby provide various flavors to a user who uses the aerosol generating apparatus. For example, the storage device 170 may prestore a temperature profile referred to by the controller 110 to appropriately control an increase or a decrease in a temperature of the heater 130 over time, a control reference ratio, a comparison control value, and the like and transmit corresponding information to the controller 110 according to a request of the controller 110. The storage device 170 may be configured as non-volatile memory such as flash memory and may also be configured as volatile memory that temporarily stores data only when a current is applied to secure a faster data input/output (I/O) speed.

The controller 110, the pulse width modulation processing unit 140, the display unit 150, the storage device 170, and the vaporizer according to an embodiment of the present disclosure may correspond to at least one processor or may include at least one processor. Therefore, the controller 110, the pulse width modulation processing unit 140, the display unit 150, the storage device 170, and the vaporizer may be driven in the form included in another hardware device such as a microprocessor or a general-purpose computer system.

For convenience of description, the method of controlling, by the controller 110, power supplied to the heater 130 will be described below with reference to FIG. 7.

Figure 7:
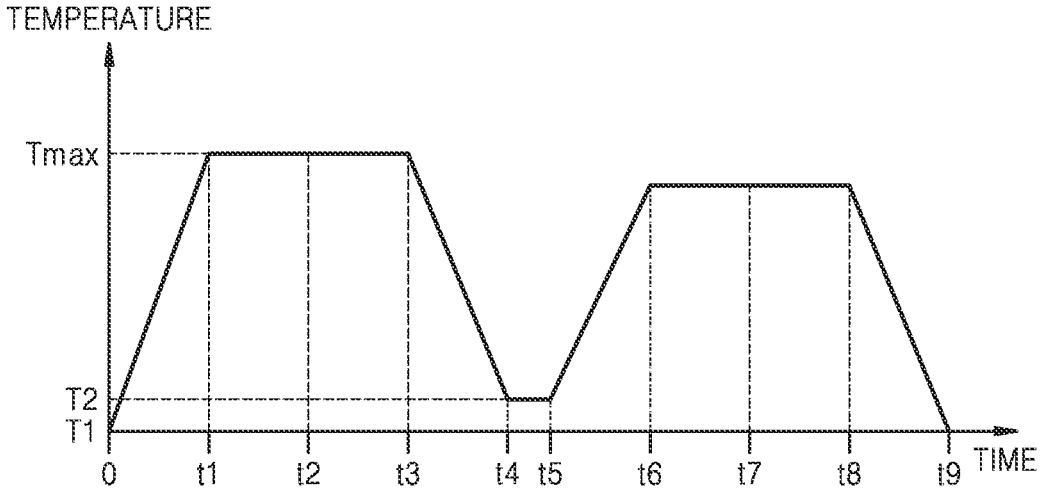
FIG. 7 is a graph illustrating a change in temperature of a heater when an aerosol generating apparatus according to the present disclosure is used continuously.

FIG. 7 is a graph illustrating a change in a temperature of a heater when an aerosol generating apparatus according to the present disclosure is continuously used.

Referring to FIG. 7, a temperature of the heater 130 of an aerosol generating apparatus according to the present disclosure rises from $T_1$ to $T_{max}$, maintains $T_{max}$ for a preset time, and drops during a one-cycle smoking process. When the heater 130 is heated to a heating target temperature $T_{max}$ and maintains the heating target temperature $T_{max}$ for a preset time, the controller 110 may notify a user, through the display unit 150 or the motor 160 provided in the aerosol generating apparatus, that preheating of the heater 130 is completed.

Hereinafter, a series of time periods in which the heater 130 is completely preheated for the first time and then falls to a preheating target temperature or less are collectively referred to as a first smoking process. Also, a series of time periods following the first smoking process, in which the heater 130 is completely preheated by being reheated and ends preheating, are referred to as a second smoking process. In other words, in FIG. 7, a first smoking process may be from a time point 0 to a time point $t_4$, and a second smoking process may be from a time point is to a time point $t_9$. A user may inhale an aerosol generated in the aerosol generating apparatus by performing at least one puff in a first smoking process. In FIG. 7, when the heater 130 maintains a preheating target temperature $T_{max}$ for a preset time from a time point $t_1$ to a time point $t_2$, the controller 110 may control an aerosol to be generated from the time point $t_2$ at which preheating is completed. When the aerosol is generated from the time point $t_2$ to a time point $t_3$, a power supply to the heater 130 is interrupted by the controller 110, and thus, a temperature of the heater 130 falls gradually until the time point $t_4$.

Next, when a user applies, to the aerosol generating apparatus, an input of reheating the heater 130 for smoking, the controller 110 resumes supplying power to the heater 130 based on the user input. In FIG. 7, when the controller 110 receives an input of reheating the heater 130 at the time point $t_4$, after the temperature drops from the time point $t_3$ to the time point $t_4$, undergoes a short period for a temperature rise between the time point $t_4$ and the time point $t_5$, and is reheated from the time point $t_5$ to the preheating target temperature.

According to an existing aerosol generating apparatus, when a temperature of the periphery of the heater 130 is still above $T_1$, the controller 110 enters a second smoking process and heats the heater 130 to a preheating target temperature $T_{max}$. Therefore, a hot aerosol is generated due to an effect of the periphery of the heater 130.

In an aerosol generating apparatus according to the present disclosure, when the controller 110 receives an input of reheating the heater 130 within a preset time after the heater 130 generated an aerosol with a preheating target temperature, the controller 110 may control the heater 130 to generate an aerosol according to a second target temperature lower than the preheating target temperature to thereby prevent a user from being scalded or feeling uncomfortable due to a hot aerosol. Hereinafter, for convenience of description, a preheating target temperature $T_{max}$ in a first smoking process is referred to as a first target temperature, and a preheating target temperature in a second smoking process is referred to as a second target temperature.

In FIG. 7, the controller 110 controls power supplied to the heater 130 such that a temperature of the heater 130 reaches a second target temperature, and completes preheating when the temperature of the heater 130 the second target temperature is maintained for a time period from a time point $t_6$ to a time point $t_7$. A user may detect, through the display unit 150 or the motor 160 of the aerosol generating apparatus, that preheating of the heater 130 is completed at the time point $t_7$ and may inhale an aerosol generated from the time point $t_7$ to a time point $t_8$. At the time point $t_8$, the controller 110 lowers a temperature of the heater 130 by interrupting power supplied to the heater 130.

As an alternative embodiment, the controller 110 may calculate a second target temperature on the basis of a first target temperature. If the controller 110 sets a second target temperature to a random temperature lower than a first target temperature and applies the second target temperature in a second smoking process, heat energy transmitted to an aerosol generating substrate may not be uniform, and thus, a consistent feeling of smoking may not be provided to a user. According to the present alternative embodiment, as the controller 110 uses the first target temperature as one parameter to set the second target temperature, the controller 110 may calculate and apply a second target temperature according to a consistent standard each time.

As another alternative embodiment, the controller 110 may also calculate a second target temperature on the basis of a temperature of the heater 130 at a time point when the controller 110 receives an input of reheating the heater 130 after a first smoking process ends. In the present alternative embodiment, the time point when the input of reheating the heater 130 is received refers to the time point $t_4$ of FIG. 7. According to the present alternative embodiment, as the controller 110 uses the temperature of the heater 130 at the time point when receiving the input as a parameter to set the second target temperature, the controller 110 may calculate the second target temperature according to a consistent standard each time.

$$T_{max2} = T_{max} - \frac{T_p}{a} \quad \text{[Equation 1]}$$

Equation 1 shows an example of an equation to be used by the controller 110 to calculate a second target temperature. In Equation 1 above, $T_{max2}$ denotes a second target temperature, $T_{max}$ denotes a first target temperature, $T_p$ denotes a temperature of a heater at a time point when a controller receives a reheating input with respect to the heater, and parameter a denotes a constant randomly selected from 5 to 30. Equation 1 may be construed as a linear equation where an inclination is −1/a, and a y intercept is a first target temperature, assuming that a temperature of a heater at a time point when a user performs a reheating input with respect to the heater is a variable. As in Equation 1, on the basis of at least one of a first target temperature or a temperature of the heater 130 at a time point when the controller 130 receives a reheating input with respect to the heater 130, the controller 110 may calculate a second target temperature and apply the second target temperature to raise the temperature of the heater 130.

As an alternative embodiment different from the above-described example, the controller 110 may acquire a second target temperature based on a table where second target temperatures are associated with temperature ranges of a heater at a time point when receiving a reheating input with respect to the heater 130.

TABLE 1

| Temperature Range to which Temperature of Heater Belongs (Degree) | Second Target Temperature (Degree) |
|---|---|
| 50-100 | Tmax-5 |
| 100-150 | Tmax-10 |
| 150-200 | Tmax-15 |
| 200-250 | Tmax-20 |

Table 1 shows an example of a table to which the controller 110 refers. In more detail, Table 1 shows a second target temperature which varies according to a temperature range to which a temperature of the heater 130 belongs at a time point when the controller 110 receives a reheating input with respect to the heater 130 after a first smoking process ends. For example, when a first target temperature is 200° C., and a temperature of the heater 130 is 70° C. at a time point when the controller 110 receives a reheating input with respect to the heater 130, the controller 110 may determine, as a second target temperature, 195° C. acquired by subtracting 5° C. from 200° C. with reference to Table 1. Table 1 may be generated by statistically analyzing mathematical, experiential, and experimental values. Table 1 may be stored in the controller 110 or the storage device 170 of an aerosol generating apparatus according to the present disclosure, and may be looked up in a process of calculating a second target temperature.

As another alternative embodiment different from the above-described example, when a preset maintenance time period passes after the heater 130 reaches a first target temperature or a second target temperature, the controller 110 may determine that preheating of the heater 130 is completed and control a maintenance time period for maintaining the second target temperature to be longer than a maintenance time period for maintaining the first target temperature.

Figure 8:
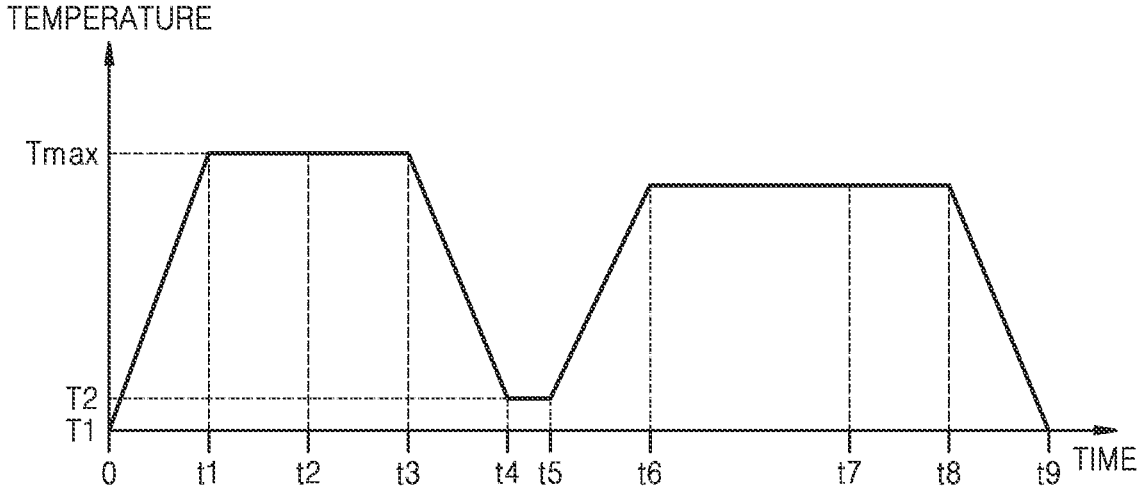
FIG. 8 is a graph for explaining an alternative embodiment of changing a maintenance time period corresponding to a second target temperature.

FIG. 8 is a graph for explaining an alternative embodiment of changing a maintenance time period for maintaining a second target temperature.

Comparing FIG. 8 to FIG. 7, the graphs are similar to each other except for a time period between a time point $t_6$ and a time point $t_7$. Here, the time period between the time point $t_6$ and the time point $t_7$ is after the heater 130 reaches a second target temperature lower than a first target temperature $T_{max}$. The controller 110 completes preheating of the heater 130 when the heater 130 maintains the second target temperature until the time point $t_7$ after a temperature of the heater 130 reaches the second target temperature (at $t_6$).

As the controller 110 maintains a second target temperature of the heater 130 lower than a first target temperature for a long time in a second smoking process as in FIG. 8, an overheated aerosol may not be generated by the periphery of an aerosol generating apparatus and the sufficient amount of heat energy may be transferred to an aerosol generating substrate, thereby resolving a lack of the atomization amount which may occur in each initial puff of continual use of the aerosol generating apparatus.

As illustrated in FIG. 8, a time period during which a first target temperature is maintained after preheating is completed in a first smoking process is referred to as a first maintenance time period, and a time period during which a second target temperature is maintained after preheating is completed in a second smoking process is referred to as a second maintenance time period. In this case, the controller 110 may set the second maintenance time period to be longer than the first maintenance time period. For example, the second maintenance time period may be calculated on the basis of a temperature of the heater 130 at a time point when a reheating input with respect to the heater 130 is received.

$$t_{m2} = t_{m1} + \left(\frac{T_p}{\alpha} + C\right) \quad \text{[Equation 2]}$$

Equation 2 shows an example of an equation to be used by the controller 110 to calculate a second maintenance time period. In Equation 2, $t_{m2}$ denotes a second maintenance time period, $t_{m1}$ denotes a first maintenance time period, $T_p$ denotes a temperature of the heater 130 at a time point when the controller 110 receives a reheating input with respect to the heater 130, parameter a denotes a constant randomly selected from about 5 to about 30, and C denotes a constant randomly selected from about 0 to about 5. Equation 2 may be construed as a linear equation where an inclination is 1/a, and a y intercept is a sum of a first target temperature and a constant C, assuming that a temperature of the heater 130 at a time point when a user performs a reheating input with respect to the heater 130 is a variable.

As in Equation 2, on the basis of at least one of a first maintenance time period and a temperature of the heater 130 at a time point when the controller 110 receives a reheating input with respect to the heater 130, the controller 110 may calculate a second maintenance time period. As such, the heater 130 may reach a second target temperature and maintain the second target temperature for the second maintenance time period, thereby transmitting the sufficient amount of heat energy to an aerosol generating substrate.

As another example, the controller 110 may use a table stored in the controller 110 or the storage device 170, instead of using Equation 2, to acquire a second maintenance time period.

TABLE 2

| Temperature Range (degree) to which Temperature of Heater Belongs | Second Maintenance time period (second) |
|---|---|
| 50-100 | tm1 + 3 |
| 100-150 | tm1 + 4 |
| 150-200 | tm1 + 5 |
| 200-250 | tm1 + 6 |

Table 2 shows an example of a table to which the controller 110 refers to determine a second maintenance time period. In more detail, Table 2 shows a second maintenance time period which varies according to a temperature range to which a temperature of the heater 130 belongs at a time point when the controller 110 receives a reheating input with respect to the heater 130 after a second smoking process starts. For example, when a first maintenance time period is 20 seconds, and a temperature of the heater 130 is 70° C. at a time point when the controller 110 receives a reheating input with respect to the heater 130, the controller 110 may determine 23 seconds as a second maintenance time period with reference to Table 2. Table 2 may be generated by statistically analyzing mathematical, experiential, and experimental values. Table 2 may be stored in the controller 110 or the storage device 170 of an aerosol generating apparatus according to the present disclosure, and may be looked up by the controller 110 in a process of calculating a second maintenance time period. As another alternative embodiment, the controller 110 may control a second arrival time period during which the heater 130 is heated and reaches a second target temperature to be longer than a first arrival time period during which the heater 130 is heated to reach a first target temperature. In particular, the controller 110 may acquire the second arrival time period with reference to a table where the second arrival time period is associated to a corresponding temperature range to which a temperature of the heater 130 belongs at a time point when the controller 110 receives a reheating input with respect to the heater 130.

Figure 9:
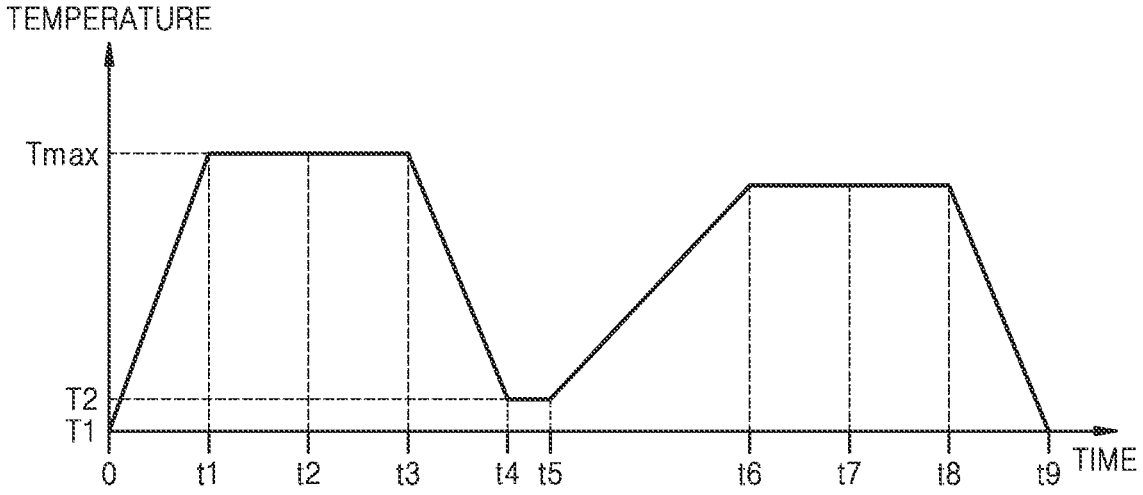
FIG. 9 is a graph for explaining an alternative embodiment of determining a second arrival time period.

FIG. 9 is a graph for explaining an alternative embodiment of determining a second arrival time period.

Comparing FIG. 9 to FIG. 7, the graphs are similar to each other except for a time period between a time point $t_5$ and a time point $t_6$. Here, the time period between the time point $t_5$ and the time point $t_6$ is a time taken for the heater 130 to reach a second target temperature lower than a first target temperature $T_{max}$. The controller 110 ends preheating when the heater 130 maintains the second target temperature until a time point $t_7$ after a temperature of the heater 130 reaches the second target temperature (at the time point $t_6$).

The controller 110 may control a second arrival time period to be longer than a first arrival time period by lowering a percentage of a duty of a pulse width modulation (PWM) signal for supplying power which is transmitted to the heater 130. If the percentage of the duty of the PWM signal is lowered, a temperature rise rate of the heater 130 per hour, i.e., an inclination between the time point $t_5$ and the time point $t_6$, changes as illustrated in FIGS. 7 through 9.

TABLE 3

| Temperature Range to which Temperature of Heater Belongs (Degree) | Percentage of PWM Duty Used (%) |
|---|---|
| 0-50 | 95 |
| 50-100 | 65 |

TABLE 3-continued

| Temperature Range to which Temperature of Heater Belongs (Degree) | Percentage of PWM Duty Used (%) |
|---|---|
| 100-150 | 55 |
| 150-200 | 45 |
| 200-250 | 35 |

Table 3 shows an example of a table to which the controller 110 refers to determine a second arrival time period. In more detail, Table 3 shows a second arrival time period which varies according to a temperature range to which a temperature of the heater 130 belongs at a time point when the controller 110 receives a reheating input with respect to the heater 130 after a second smoking process starts. For example, when a temperature of the heater 130 is 70° C. at a time point when the controller 110 receives a reheating input with respect to the heater 130, the controller 110 may determine 60% as a PWM duty with reference to Table 3. Table 3 may be generated by statistically analyzing mathematical, experiential, and experimental values. Table 3 may be stored in the controller 110 or the storage device 170 of an aerosol generating apparatus according to the present disclosure, and may be looked up by the controller 110 in a process of setting a second arrival time period. As described above, the controller 110 may adjust and set a second target temperature or a second arrival time period according to various embodiments such that an overheated aerosol is not generated and the sufficient amount of heat energy is transmitted to an aerosol generating substrate, thereby providing a user with a consistent smoking sense although the user continuously uses an aerosol generating apparatus.

Figure 10:
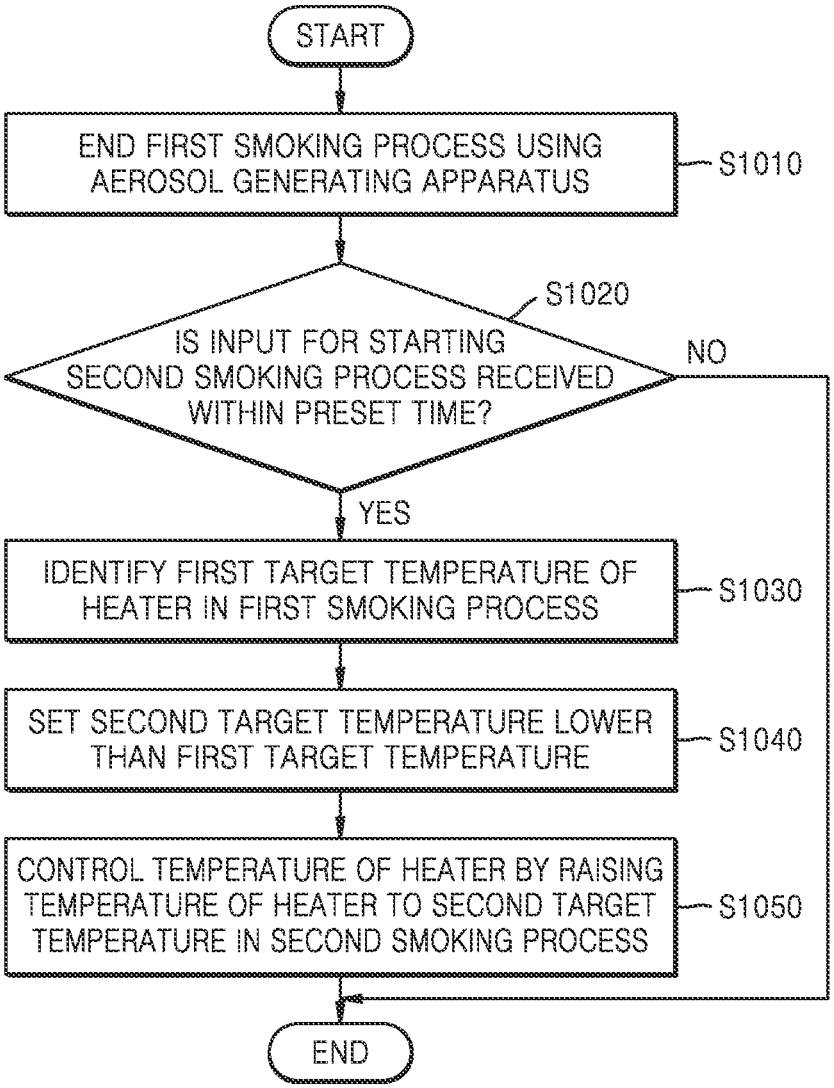
FIG. 10 is a flowchart of an example of a method of controlling power supplied to a heater of an aerosol generating apparatus according to the present disclosure.

FIG. 10 is a flowchart of an example of a method of controlling power supplied to a heater of an aerosol generating apparatus according to the present disclosure.

The method of FIG. 10 may be embodied by the aerosol generating apparatus of FIG. 6, and thus the embodiment will be described with reference to FIG. 6. Also, hereinafter, the same descriptions of FIG. 10 as those of FIGS. 6 through 9 will be omitted.

In operation S1010, a first smoking process using an aerosol generating apparatus ends.

In operation S1020, the controller 110 detects whether or not an input for starting a second smoking process is received within a preset time. For example, a user's act of operating a switch on an aerosol generating apparatus or inserting a cigarette into a portion of the aerosol generating apparatus may be an input for starting a second smoking process.

When the input for starting the second smoking process is received, the controller 110 identifies a first target temperature $T_{max}$ of the heater 130 in the first smoking process in operation S1030.

In operation S1040, the controller 110 sets a second target temperature lower than the first target temperature identified in operation S1030. In operation S1040, the second target temperature may be calculated on the basis of the first target temperature or a current temperature of the heater 130. Also, the second target temperature may be set according to a table stored in the storage device 170.

In operation S1050, the controller 110 controls a temperature of the heater 130 by raising a temperature of the heater 130 to the second target temperature in the second smoking process.

Figure 11:
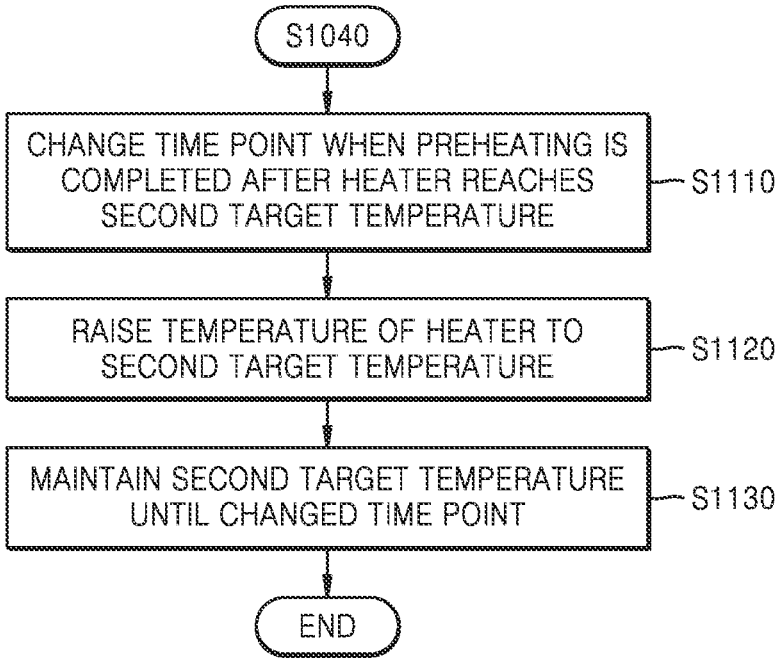
FIG. 11 is a flowchart of an example of a method of controlling power supplied to a heater by calculating a second maintenance time period.

FIG. 11 is a flowchart of an example of a method of controlling power supplied to a heater by calculating a second maintenance time period.

The method of FIG. 11 will be described with reference to FIGS. 6 through 10, and the same descriptions of FIG. 11 as those of FIGS. 6 through 10 will be omitted hereinafter.

After the controller 110 sets, in operation S1040, the second target temperature lower than the first target temperature identified in operation S1030, the controller 110 changes a time point when preheating is completed after the heater 130 reaches the second target temperature in operation S1110. In more detail, the controller 110 acquires, via a particular equation or table, a second maintenance time period during which the heater 130 maintains the second target temperature after reaching the second target temperature.

In operation S1120, the controller 110 raises a temperature of the heater 130 to the second target temperature.

In operation S1130, the controller 110 controls the heater 130 to maintain the second target temperature for the second maintenance time period.

Figure 12:
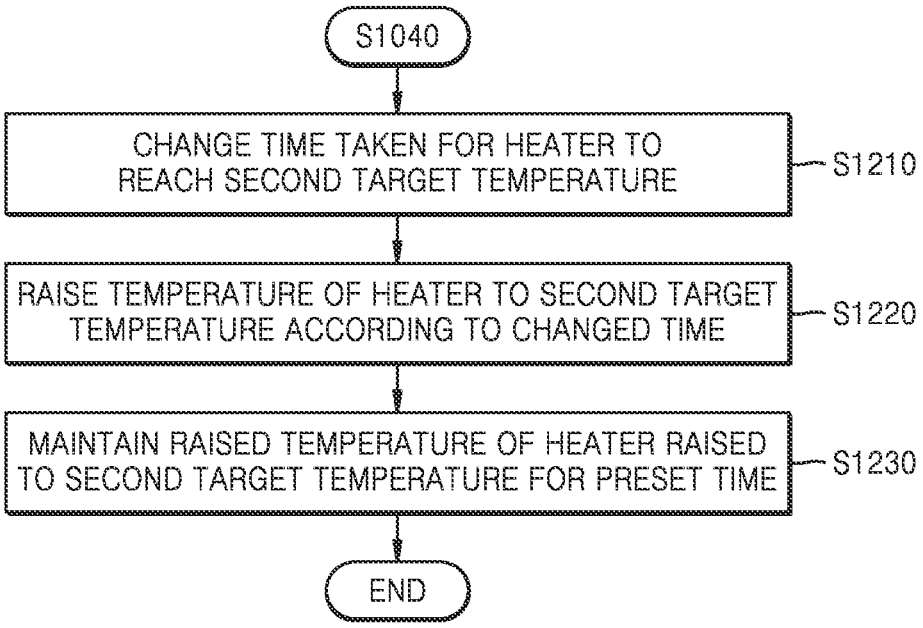
FIG. 12 is a flowchart of an example of a method of controlling power supplied to a heater by calculating a second arrival time period.

FIG. 12 is a flowchart of an example of a method of controlling power supplied to a heater by calculating a second arrival time period.

The method of FIG. 12 will be described with reference to FIGS. 6 through 10, and the same descriptions of FIG. 12 as those of FIGS. 6 through 10 will be omitted hereinafter.

After the controller 110 sets, in operation S1040, the second target temperature lower than the first target temperature identified in operation S1030, the controller 110 changes a second arrival time period which is a time taken for the heater 130 to reach the second target temperature in operation S1210. In more detail, the controller 110 acquires, from a particular table, a percentage (a PWM duty ratio) of a PWM duty related to a temperature rise rate of the heater 130 per hour.

In operation S1220, the controller 110 raises a temperature of the heater 130 to the second target temperature over a second arrival time period.

In operation S1230, the controller 110 controls the heater 130, which is raised to the second target temperature, to maintain the second target temperature for a preset time.

The embodiments of the present disclosure may be implemented in the form of a computer program which may be executed on a computer via various types of components, and such a computer program may be recorded on a computer-readable recording medium. The medium may include a magnetic medium such as a hard disk, a floppy disk, and a magnetic tape, an optical recording medium such as CD-ROM and DVD, a magneto-optical medium such as a floptical disk, and a hardware device specifically configured to store and execute program instructions, such as ROM, RAM, and flash memory.

The computer program is specifically designed and configured for the present disclosure but may be known to and used by one of ordinary skill in the computer software field. Examples of the computer program may include a high-level language code which may be executed using an interpreter or the like by a computer, as well as a machine language code such as that made by a complier.

The specific implementations described in the present disclosure are example embodiments and do not limit the scope of the present disclosure in any way. For brevity of the specification, descriptions of existing electronic configurations, control systems, software, and other functional aspects of the systems may be omitted. Connections of lines or connection members between components illustrated in the drawings illustratively show functional connections and/or physical or circuit connections and may be represented as alternative or additional various functional connections, physical connections, or circuit connections in an actual device. Unless specifically mentioned, such as "essential", "importantly", etc., the components may not be necessary components for application of the present disclosure.

As used herein (in particular, in claims), use of the term "the" and similar indication terms may correspond to both singular and plural. When a range is described in the present disclosure, the present disclosure may include the invention to which individual values belonging to the range are applied (unless contrary description), and each individual value constituting the range is the same as being described in the detailed description of the disclosure. Unless there is an explicit description of the order of the steps constituting the method according to the present disclosure or a contrary description, the steps may be performed in an appropriate order. The present disclosure is not necessarily limited to the description order of the steps. The use of all examples or example terms (for example, etc.) is merely for describing the present disclosure in detail, and the scope of the present disclosure is not limited by the examples or the example terms unless the examples or the example terms are limited by claims. It will be understood by one of ordinary skill in the art that various modifications, combinations, and changes may be made according to the design conditions and factors within the scope of the appended claims or equivalents thereof.

INDUSTRIAL APPLICABILITY

One embodiment of the present disclosure may be used to manufacture a next-generation electronic cigarette having further improved performances than existing electronic cigarettes.

What is claimed is:

1. An aerosol generating apparatus comprising:

a heater configured to generate an aerosol by heating an aerosol generating substrate; and a controller configured to monitor and control power supplied to the heater such that the heater generates the aerosol in a second smoking process at a second target temperature lower than a first target temperature in a first smoking process upon receiving an input for starting the second smoking process within a preset time after the heater generates the aerosol at the first target temperature in the first smoking process.

2. The aerosol generating apparatus of claim 1, wherein the controller is further configured to calculate the second target temperature based on the first target temperature.

3. The aerosol generating apparatus of claim 1, wherein the controller is further configured to calculate the second target temperature based on a temperature of the heater at a time point when the input is received.

4. The aerosol generating apparatus of claim 3, wherein the controller is further configured to calculate the second target temperature according to a linear equation based on the temperature of the heater at the time point when the input is received.

5. The aerosol generating apparatus of claim 1, wherein the controller is further configured to acquire the second target temperature with reference to a table in which the second target temperature is associated with a temperature range to which a temperature of the heater belongs at a time point when the input is received.

6. An aerosol generating apparatus comprising:

a heater configured to generate an aerosol by heating an aerosol generating substrate; and a controller configured to monitor and control power supplied to the heater such that the heater generates the aerosol at a second target temperature lower than a first target temperature upon receiving an input of reheating the heater within a preset time after the heater generates the aerosol at the first target temperature, wherein the controller is further configured to:

determine that preheating of the heater is completed when a maintenance time period during which the first target temperature is maintained or a maintenance time period during which the second target temperature is maintained expires, and control the power such that the maintenance time period during which the second target temperature is longer than the maintenance time period during which the first target temperature is maintained.

7. The aerosol generating apparatus of claim 6, wherein the maintenance time period during which the second target temperature is maintained is calculated based on a temperature of the heater at a time point when the input is received.

8. An aerosol generating apparatus comprising:

a heater configured to generate an aerosol by heating an aerosol generating substrate; and a controller configured to monitor and control power supplied to the heater such that the heater generates the aerosol at a second target temperature lower than a first target temperature upon receiving an input of reheating the heater within a preset time after the heater generates the aerosol at the first target temperature, wherein the controller is further configured to control the power such that a second arrival time period during which the heater is heated and reaches the second target temperature is longer than a first arrival time period during which the heater is heated and reaches the first target temperature.

9. The aerosol generating apparatus of claim 8, wherein the controller is further configured to acquire the second arrival time period with reference to a table in which the second arrival time period is associated with a temperature range to which a temperature of the heater belongs at a time point when the input is received.

* * * * *